US005429206A

United States Patent [19]

Nusbaum

[11] Patent Number: 5,429,206

[45] Date of Patent: Jul. 4, 1995

[54] SAFETY NET ARRANGEMENT FOR ELEVATED STRUCTURES AND METHOD

[75] Inventor: Arthur Nusbaum, Fort Lee, N.J.

[73] Assignee: Nussel, Inc., Wilmington, Del.

[21] Appl. No.: 187,812

[22] Filed: Jan. 27, 1994

Related U.S. Application Data

[63] Continuation of Ser. No. 936,853, Aug. 20, 1992, abandoned.

[51] Int. Cl.[6] ..... E04G 21/32

[52] U.S. Cl. ..... 182/138; 248/228; 182/82

[58] Field of Search ..... 182/137-140, 182/82; 248/228

[56] References Cited

U.S. PATENT DOCUMENTS

| | | | |
|---|---|---|---|
| 1,523,597 | 1/1925 | Lang | 248/228 |
| 3,140,848 | 7/1964 | Sherburne | 248/228 X |
| 4,171,032 | 10/1979 | Woolslayer et al. | 248/228 X |
| 4,732,234 | 3/1988 | Brickman | 182/138 |
| 4,944,365 | 7/1990 | Shalders | 182/138 |
| 5,083,636 | 1/1992 | Goldenberg | 182/138 |

FOREIGN PATENT DOCUMENTS

| | | | |
|---|---|---|---|
| 2409766 | 7/1979 | France | 182/138 |
| 2802220 | 7/1979 | Germany | 182/138 |

OTHER PUBLICATIONS

Sinco Handbook of Passive Fall Protectors, 1985, pp. 9 and 10.

*Primary Examiner*—Alvin C. Chin-Shue
*Attorney, Agent, or Firm*—Kirschstein, et al.

[57] ABSTRACT

Construction workers on a railway trestle bridge are protected from injury by supportably suspending nets generally outwardly away from the bridge. Each net is non-destructively fastened to I-beams supporting the bridge.

18 Claims, 7 Drawing Sheets

SAFETY NET ARRANGEMENT FOR ELEVATED STRUCTURES AND METHOD

This is a continuation of application Ser. No. 07/936,853, filed Aug. 20, 1992, now abandoned.

BACKGROUND OF THE INVENTION

1. Field of the Invention

This invention generally relates to a safety arrangement for and a method of protecting workers from injury while working on an elevated structure such as a railway bridge, as well as to a method of installing such an arrangement.

2. Description of Related Art

It was known from my U.S. Pat. Nos. 3,949,834; 4,838,382 and 4,856,615, and from my pending allowed U.S. patent application Ser. No. 07/784,559 filed Oct. 29, 1991, to erect safety nets adjacent an outer face of a building under construction in order to catch workers and/or objects falling off a floor above the net, thereby protecting the fallen worker, workers on lower floors, as well as passersby at ground level, from being injured. It was also known from my pending allowed U.S. patent application Ser. No. 07/789,660 filed Nov. 8, 1991, to suspend a safety net across an open elevator shaft for catching workers and/or objects falling down the elevator shaft in a multi-floor building under construction.

A common feature of those known safety net arrangements was that the nets were supported by net supports which were anchored on the building under construction. A plurality of anchor holes were formed at the periphery of one or more floors of the building, and floor brackets were anchored to the floor by anchor bolts positioned in the various anchor holes. The formation of such anchor holes, the mounting of anchor bolts therein, and the eventual removal of the anchor bolts from the anchor holes during building construction was a labor-intensive and expensive task.

During the maintenance, repair or construction of such elevated structures as a bridge, particularly a railway trestle bridge, at a considerable height off the ground, it was known to protect workers from injury by suspending nets outwardly of the bridge. Such a railway bridge included at least one pair of parallel steel I-beams for supporting railway ties on which a pair of rails were supported. Each I-beam included a web and a pair of upper and lower flanges integral therewith. Even though each I-beam had considerable inherent strength and, for example, each web might be on the order of one meter high, it was conventional to weld L-shaped stiffeners at various locations on and along the web to prevent buckling due to the weight of passing railroad cars, especially loaded freight cars. The aforementioned known bridge nets were supported by net supports from the I-beams. These net supports were anchored in anchor holes which were either drilled into the web itself or, preferably, into the stiffeners. In either event, the physical integrity and strength of the supporting I-beams were weakened. Sometimes the stiffeners were pre-drilled with holes, but this was for the purpose of accommodating the routing of communication and/or power electrical cables underneath the bridge. If the electrical cables were not in place, then the net supports could be fastened by anchor bolts using the pre-drilled holes in the stiffeners. However, it was more frequently the case that the pre-drilled holes were used for their intended cable-routing purpose, and there simply were no holes available to receive anchor bolts to which the net supports could be attached. As in the case of installing safety nets on buildings under construction, the formation of such anchor holes in the I-beams, the mounting of anchor bolts therein, and the eventual removal of anchor bolts therefrom was a labor-intensive task and was all the more difficult in the case of a railway trestle bridge. It was far easier to form holes at the periphery of a building floor under construction where access and power tools were readily available, as compared to the case of forming anchor holes in an I-beam located underneath the railway ties.

SUMMARY OF THE INVENTION

1. Objects of the Invention

It is a general object of this invention to reliably catch workers falling off an elevated structure such as a railway bridge during maintenance, repair or construction.

It is another object of this invention to protect falling railway construction workers from injury and death.

Another object of this invention is to provide a safety net arrangement which is easy and inexpensive to install.

A further object of this invention is to reduce construction costs without sacrificing worker safety.

Still another object of this invention is to install safety net arrangements on elevated structures which are at least partially supported by flanged beams without drilling holes into or otherwise destroying the physical integrity or strength of the beams.

Yet another object of this invention is to adjustably install and remove a safety net arrangement on an elevated structure which is at least partially supported by flanged beams of various sizes.

A still further object of this invention is to install and remove such a safety net arrangement exteriorly of the elevated structure.

2. Features of the Invention

In keeping with these objects, and others which will become apparent hereinafter, one feature of this invention resides, briefly stated, in a safety arrangement for, as well as a method of installing the arrangement on, an elevated structure at least partially supported by a flanged beam. The arrangement comprises a net, support means for supportably suspending the net in a spread condition in which the net extends generally outwardly away from the elevated structure, and fastener means for non-destructively fastening the support means to the flanged beam while maintaining the net in the spread condition.

In the preferred application, the elevated structure is a railway trestle bridge extending along a longitudinal direction. Additional nets, additional support means and additional fastener means are arranged peripherally of the bridge on opposite sides thereof along the longitudinal direction. The flanged beam is typically a steel I-beam including a web, an upper flange and a lower flange, both flanges being integral with the web.

Each fastener means includes means for clamping the support means to one of the flanges, e.g. the upper flange, and means for gripping the support means onto the other of the flanges, i.e. the lower flange. Both the clamping means and the gripping means are adjustable to accommodate flanges of various sizes.

The clamping means includes a pair of clamping members and means for drawing them toward each other to non-destructively clasp onto the upper flange. Advantageously, one of the clamping members has a hook for hookingly engaging an outer side of the upper flange, and the other clamping member engages the inner side of the upper flange.

The gripping means includes a pair of pivotable gripping members positioned at the outer and inner sides of the lower flange, and means for pivoting the gripping members toward each other to non-destructively grip onto the lower flange. Each gripping member has an apertured part and a bent catch overlying the lower flange. The apertured parts are pivoted at bearings spaced apart by a distance greater than the width of the lower flange.

During the installation of the safety arrangement, the clamping means is readily accessible to the upper flange from the bridge, and the gripping means are movable from the outer open side of the elevated structure and swung into position underneath the lower flange prior to elevating the gripping means into position onto the lower flange. The gripping means are pivotably mounted on an inner end of an extension which is advantageously comprised of a pair of channel members between which the gripping members are pivotably connected.

Each support means includes the aforementioned extension extending from the gripping means, an upper elongated arm connected to and extending from the clamping means, and a lower elongated arm connected to and extending between the extension and the upper arm. Each support means further includes a support cable extending from the clamping means to the extension, as well as a pull-in rope extending from the clamping means to the lower arm.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
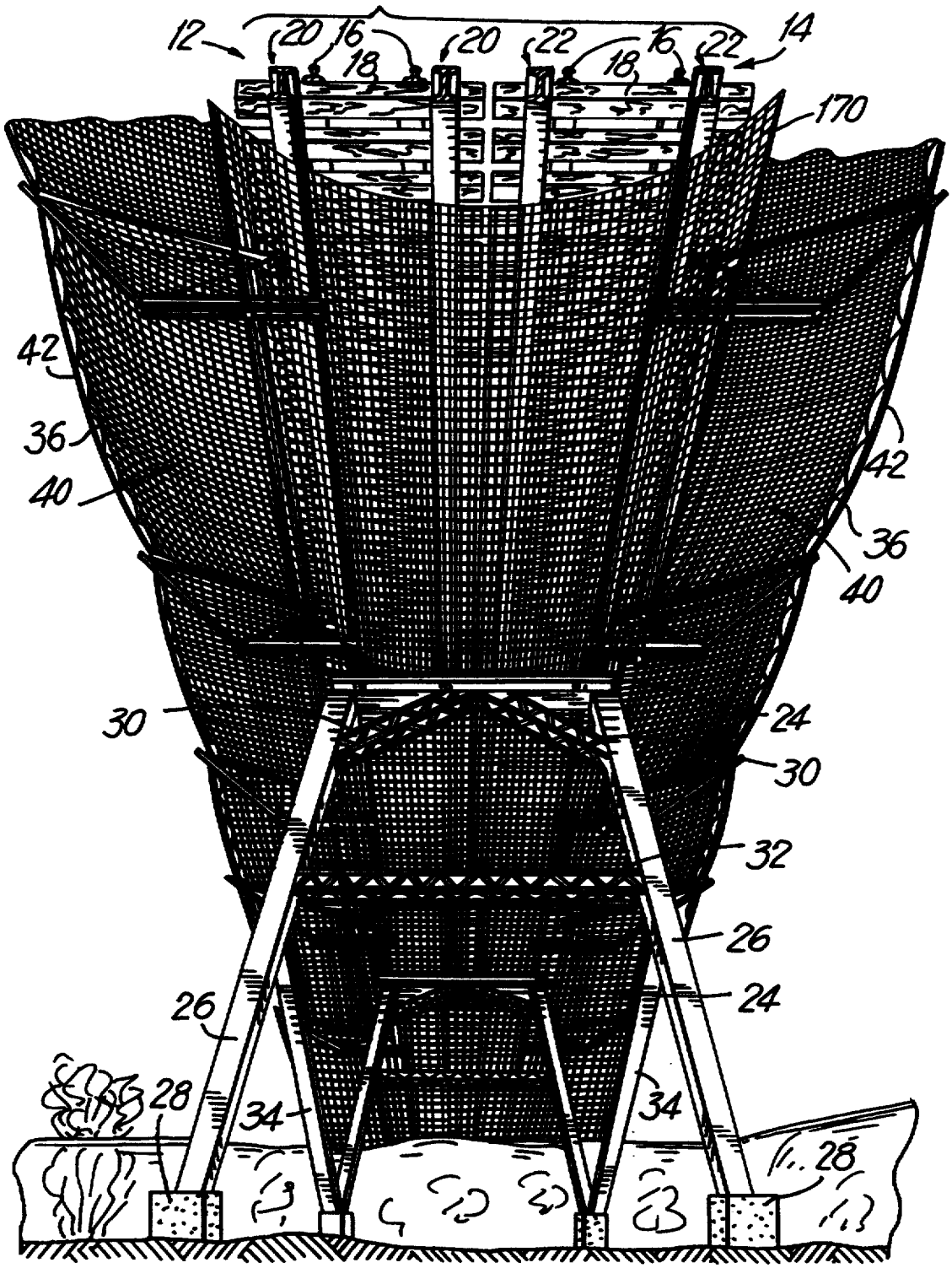
FIG. 1 is a broken-away, perspective view as seen from below a railway trestle bridge on which a safety net arrangement in accordance with this invention has been installed.

As previously described, this invention relates to a safety arrangement for an elevated structure which is at least partially supported by a flanged beam. As shown in the drawings and as described herein, the preferred elevated structure is a twin-track railway trestle bridge, but is equally well applicable to single-track railway bridges, as well as to bridges in general or elevated traffic roadways or ramps having no tracks thereon. Indeed, the safety net arrangement and method of this invention can be used with any elevated structure including a building under construction.

As shown in FIG. 1, a twin-track railway trestle bridge 10 includes a first track 12 for trains traveling in one direction, and a second track 14 for trains traveling in an opposite direction. Each track includes a pair of rails, each individually numbered 16, supported on and staked into ties, each individually numbered 18. The rails 16 and ties 18 of track 12 are at least partially supported by a pair of steel I-beams 20 and, similarly, the rails 16 and ties 18 of track 14 are at least partially supported by another pair of steel I-beams 22. All of the I-beams 20, 22 are, in turn, supported by a trestle framework including horizontal cross-pieces 24 fastened to and supported by spreading legs 26 whose feet are embedded in concrete footings. Inclined girders 30 extend between upper regions of the legs 26 and each cross-piece 24. Horizontal girders 32 extend between middle regions of the legs 26. Inclined side braces 34 extend from lower regions of the legs 26 to additional concrete footings on the ground. The illustrated structural details of the trestle framework form no part of this invention and, indeed, vary from one bridge to the next.

The safety arrangement of this invention includes at least one net, and preferably multiple nets 40 arranged peripherally of the bridge 10 and preferably along both opposite sides, as best illustrated in FIG. 1. Each net includes an elongated net fabric having opposite end regions, an outer edge 36 further from the exterior or outer face of the bridge 10, an inner edge 38 closer to the outer face of the bridge 10, and a reinforced rope or cable edging 42 which extends peripherally along all the edges of the net. In a preferred embodiment, each net 40 has a generally rectangular configuration and is about 8 meters long and about 3–5 meters in width. In a preferred installation, nets can be suspended all across the length of the bridge on one or both sides thereof. Where enough nets are not available, for example, for an extremely long bridge, the bridge can be subdivided into working sections and the nets arranged only at one or both sides of the section where work is currently being performed. The nets can then be successively moved from one section to the next to follow the work and the workers.

Each net 40 is supportably suspended in a spread condition in which the net extends generally outwardly away from the bridge 10. As illustrated, the net is not tautly strung, but, instead, its central region hangs somewhat loosely in order to more softly "catch" a fallen worker. Each net is supported by a pair of support systems 44 at opposite end regions of the net. In accordance with this invention, each support system 44 is non-destructively fastened onto the I-beams 20, 22.

Figure 3:
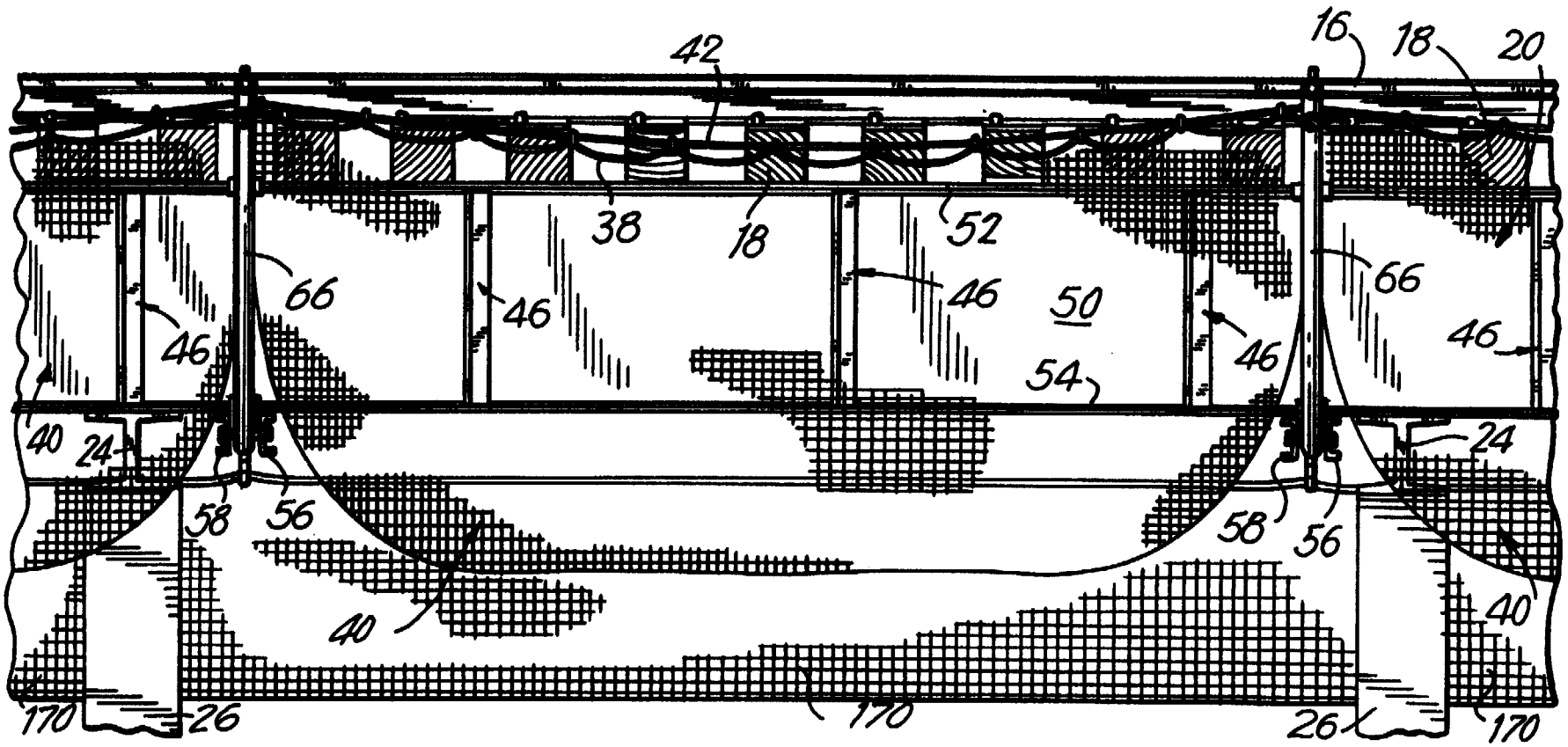
FIG. 3 is a side elevational view taken on line 3—3 of FIG. 2.

As previously described, representative I-beam 20 includes a web 50, an upper integral flange 52 adjacent the ties 18, and a lower integral flange 54 spaced away from the upper flange. Depending upon the particular load requirements, the flanges 52, 54 may have widths ranging from 15 cm to 60 cm, and the web 50 may have a height ranging up to 1.2 meters. In addition, L-shaped stiffeners 46 (see FIG. 3) are welded to and along the web 50 to prevent buckling. The stiffeners 46 are shown with holes 48 to represent either the aforementioned pre-drilled holes through which electrical cables are routed, or the holes that were formed in situ by maintenance crews in accordance with the prior art described above.

Figure 4:
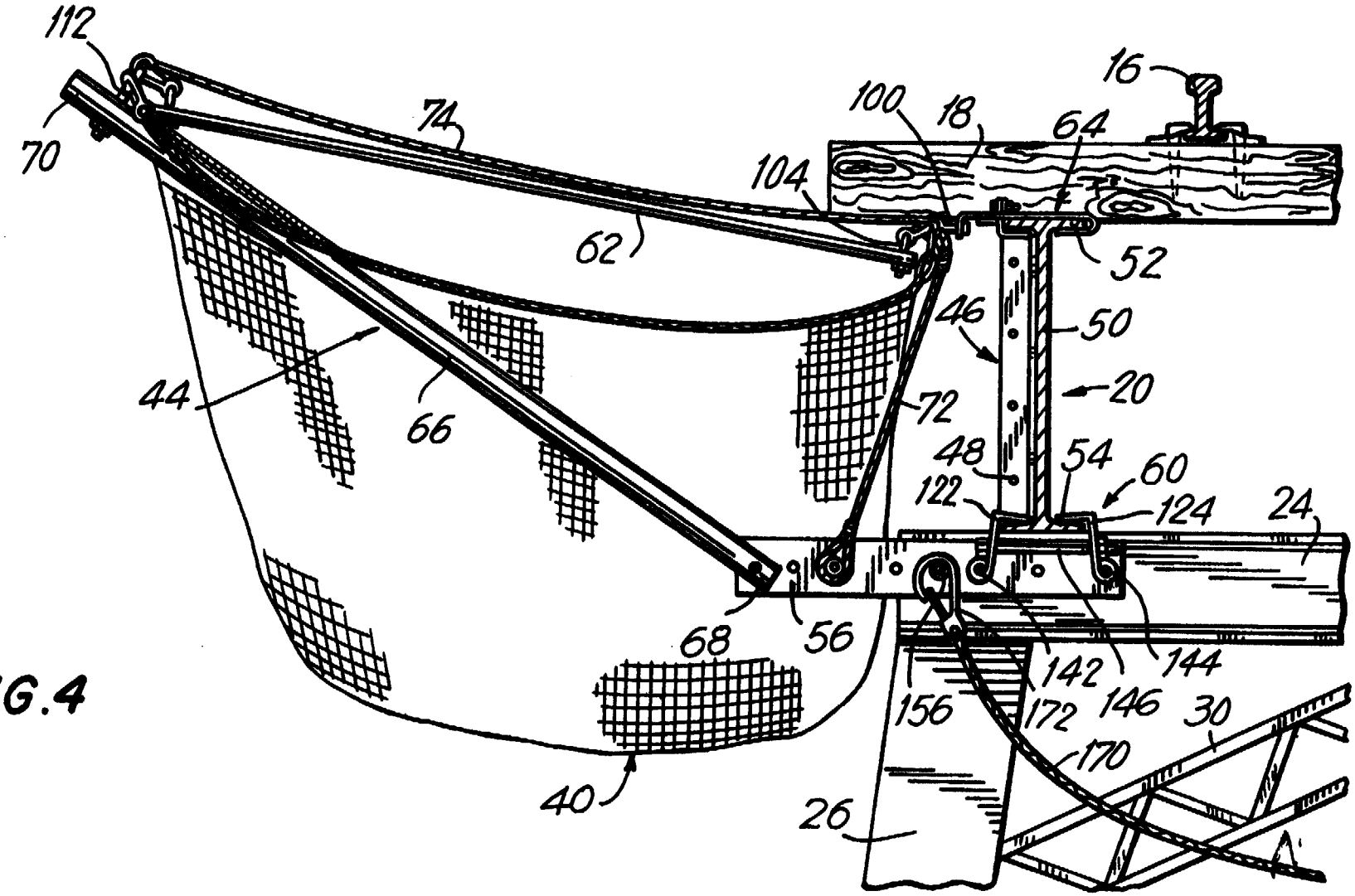
FIG. 4 is a part sectional, part elevational view taken on line 4—4 of FIG. 2.
Figure 5:
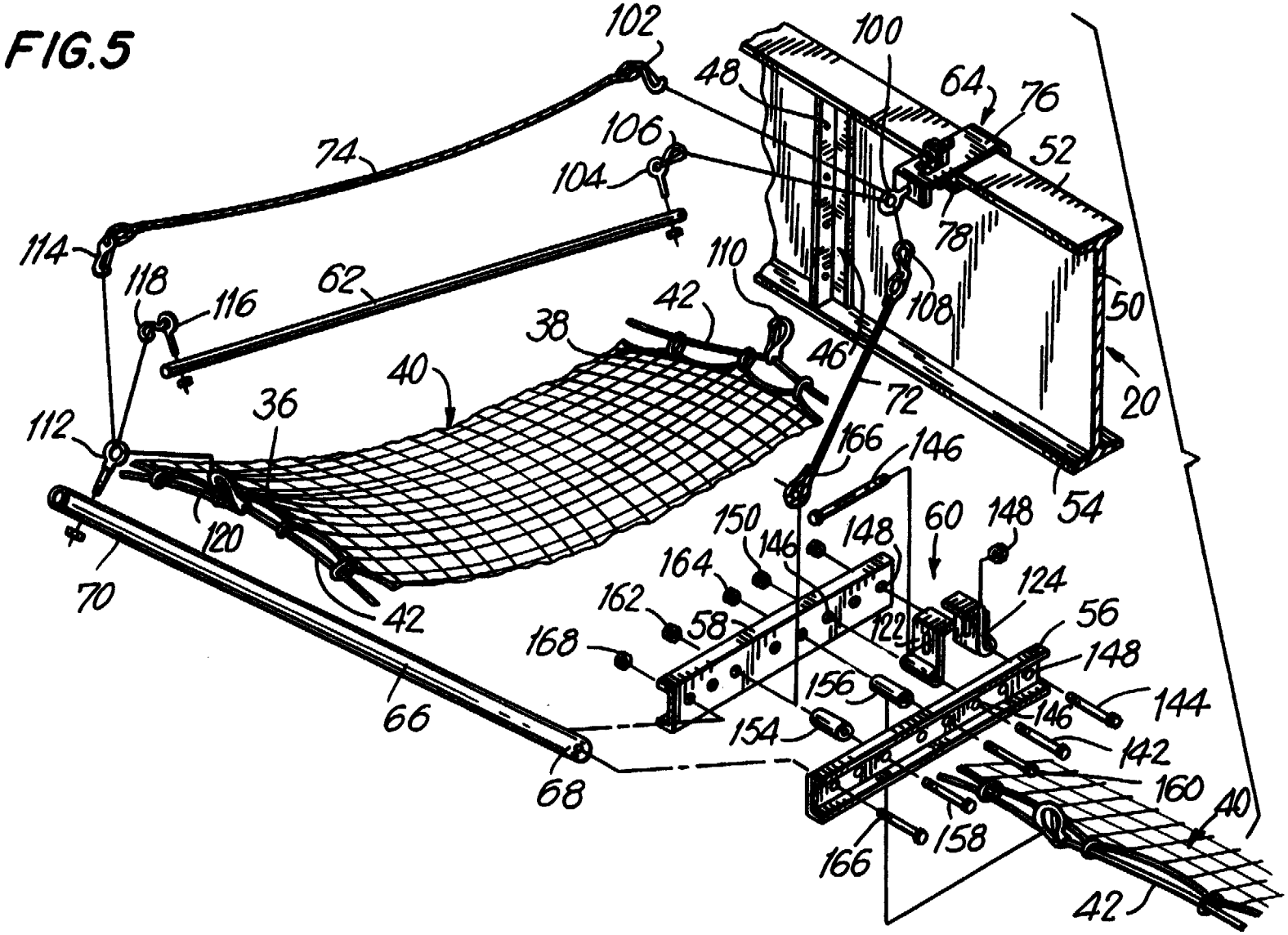
FIG. 5 is an exploded, perspective view of a detail of the arrangement of FIG. 1.

In accordance with this invention, each support system 44 is non-destructively fastened onto the I-beams 20, 22 without requiring holes such as 48 to be formed. As best shown in FIGS. 4 and 5, each support system 44 includes an elongated extension consisting of a pair of back-to-back U-shaped channel members 56, 58 having respective inner end regions operatively fastened by a gripping assembly 60 to the lower flange 54. An upper elongated arm 62 consisting of a hollow cylindrical tube has an inner end region operatively fastened by a clamping assembly 64 to the upper flange 52. A lower elongated arm 66 also consisting of a hollow cylindrical tube has an inner end 68 adjustably and pivotably connected to and between outer end regions of the channel members 56, 58, and an outer end 70 operatively connected to an outer end of the upper arm 62. Each support arm 44 also includes a support cable 72 extending downwardly and forwardly from the clamping assembly 64 to the outer end regions of the channel members 56, 58, as well as a pull-in rope 74 extending forwardly from the clamping assembly 64 to the outer end 70 of the lower arm 66.

Figure 6:
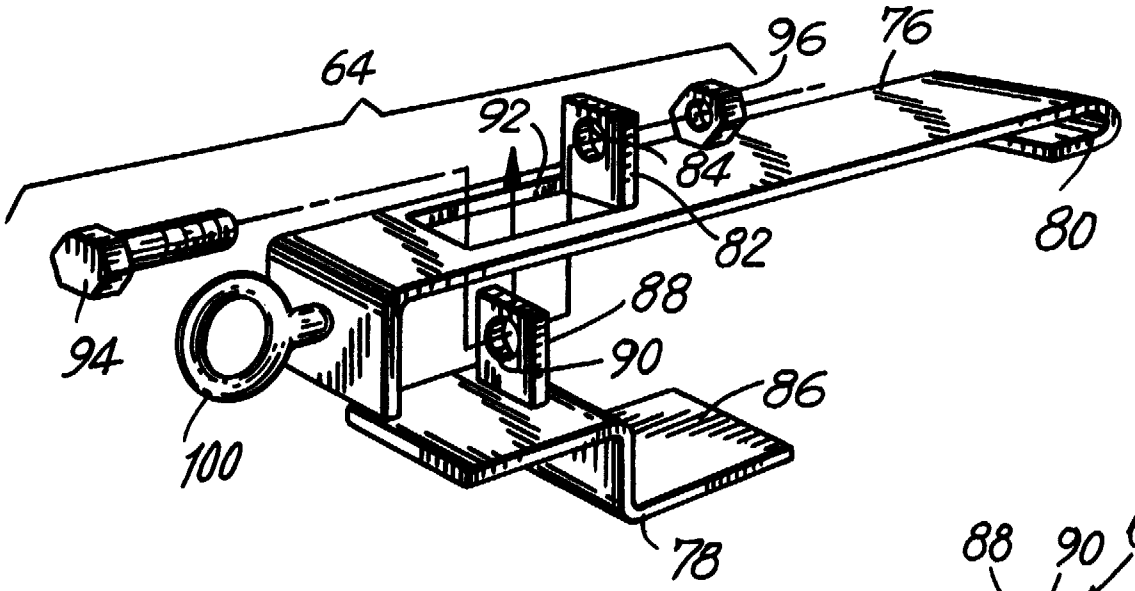
FIG. 6 an exploded, perspective view of a clamping assembly for use in the arrangement of FIG. 1.
Figure 7:
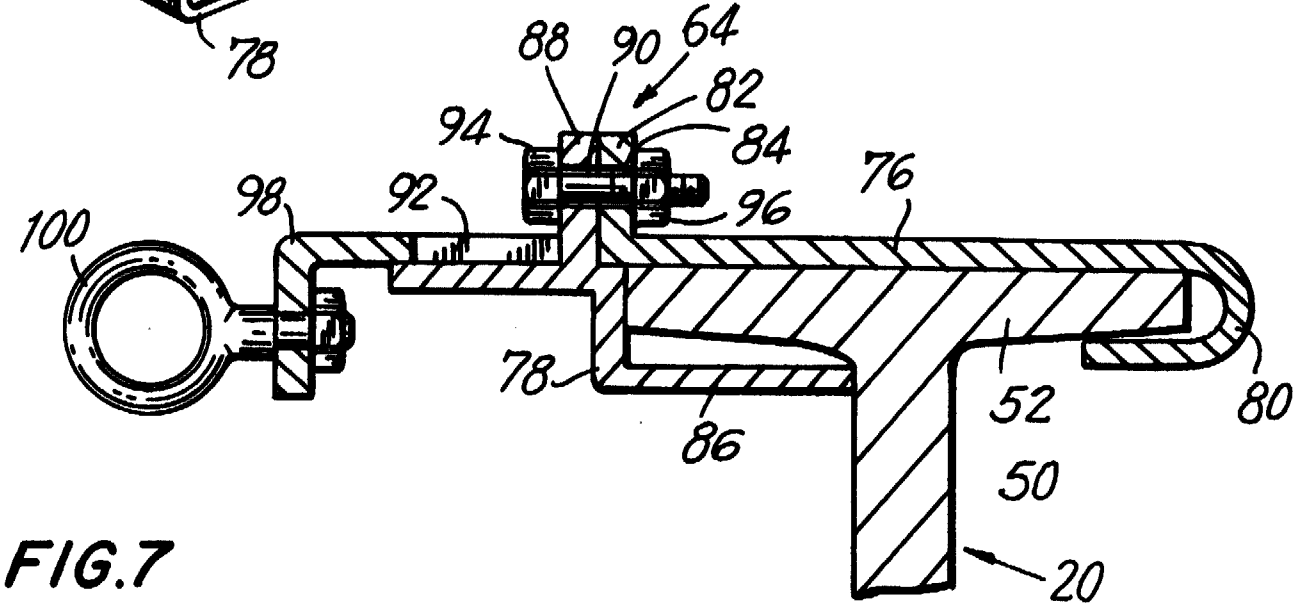
FIG. 7 is a sectional view of the clamping assembly of FIG. 6 in use.

As depicted in FIG. 6, the clamping assembly 64 includes a pair of clamping members 76, 78. Clamping member 76 includes a curved hook 80 for hookingly engaging (see FIG. 7) one side of upper flange 52, and an upstanding leg 82 having an aperture 84. Clamping member 78 includes a stepped hook 86 for receivably engaging the opposite side of upper flange 52, and an upstanding leg 88 having an aperture 92. Leg 88 extends through, and is slidably mounted in for movement along, slot 92 formed in clamping member 76. This sliding movement allows the clamping members to be fitted on upper flanges of various widths, i.e. 15–60 cm as previously noted. A threaded bolt 94 extends through the apertures 90, 84 of juxtaposed legs 88, 82, and a nut 96 is threaded onto the bolt 94. Upon relative rotation between the bolt 94 and nut 96, the clamping members 76, 78 are drawn toward each other into clamping engagement with opposite sides of upper flange 52 and non-destructively clamp onto the upper flange.

An eye-bolt 100 is threaded onto a bent end 98 of clamping member 76 and serves as a point of anchorage on which various components of each support system 44 are secured. As shown in FIG. 5, an inner looped end of pull-in rope 74 is connected to a shackle 102 which is detachably secured to bolt 100. An inner end of upper arm 62 has an eye-bolt 104 attached thereto which, in turn, is connected to a shackle 106 which is detachably secured to bolt 100. An inner looped end of support rope 72 is connected to a shackle 108 which is also detachably secured to the bolt 100. In addition, the cable edging 42 along the inner edge 38 of each net 40 has a shackle 110 which likewise is detachably secured to the bolt 100.

Another eye-bolt 112 is threaded onto the outer end 70 of the lower arm 66 and serves as another point of anchorage on which the various components of each support system 44 are secured. Again, as shown in FIG. 5, an outer looped end of pull-in rope 74 is connected to a shackle 114 which is detachably secured to bolt 112. An outer end of upper arm 62 has an eye-bolt 116 attached thereto which, in turn, is connected by a shackle 118 that is detachably secured to bolt 112. The cable edging 42 along the outer edge 36 of each net has a shackle 120 which also is detachably secured to bolt 112.

Figures 8, 9:
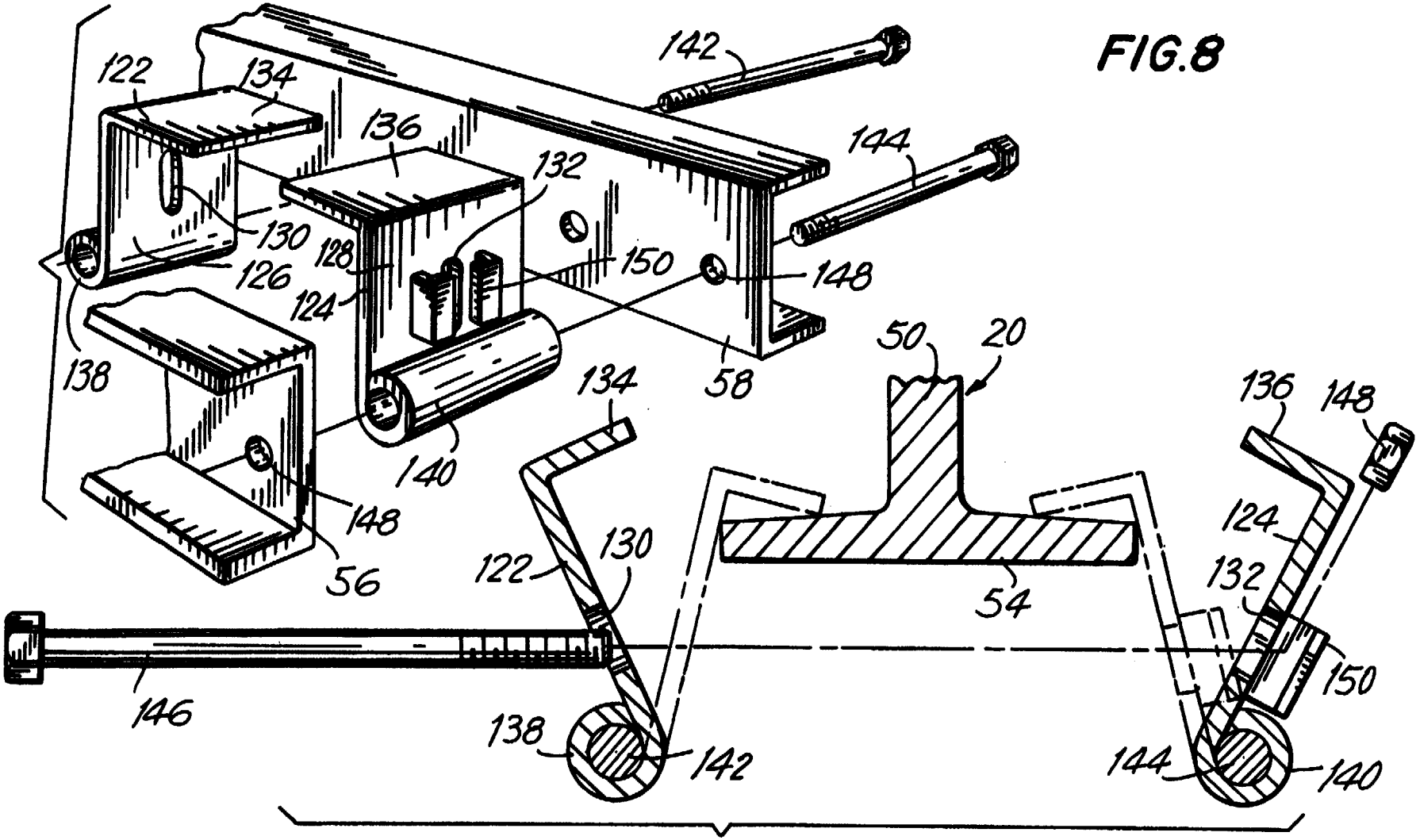
FIG. 8 is an exploded, perspective view of a gripping assembly for use in the arrangement of FIG. 1.
FIG. 9 is a sectional view of the gripping assembly of FIG. 8 movable from the solid line to the phantom line position during installation of the arrangement of FIG. 1.

As best depicted in FIGS. 5, 8 and 9, the gripping assembly 60 includes a pair of generally L-shaped gripping members 122, 124 pivotably mounted at the inner ends of channel members 56, 58. Gripping members 122, 124 respectively have apertured parts 126, 128 having vertically elongated slots 130, 132, and bent catches 134,136 for overlying upper surfaces of the lower flange 54. Gripping members 122, 124 also have pivot bearings 138, 140. Threaded bolts 142, 144 pass successively through a selected pair of apertures, e.g. 146, 148 (see FIG. 5), formed at the inner end region of one channel member 56, and pass with clearance through the bearings 138, 140, and then through a corresponding pair of apertures 146, 148 formed at the inner end region of the other channel member 58, prior to being secured in place by nuts 150, 152. The gripping members 122, 124 are free to pivot around the shafts of bolts 142, 144.

Multiple pairs of apertures are provided lengthwise along the inner end regions of channel members 56, 58. The bolts 142, 144 are inserted into the selected pair of such apertures which best accommodate the specific width of the lower flange 54. The linear distance between the selected pair of apertures is chosen to be greater than the width of the lower flange so that the gripping members 122, 124 can be moved from the net side of the bridge to a position underneath the lower flange and then elevated so that both bent catches 134, 136 (as shown in solid lines in FIG. 9) pass with clearance past the opposite sides of the lower flange 54.

Thereupon, a threaded bolt 146 is inserted through slots 130, 132, and a nut 148 is threaded thereon. Nut 148 is retained in a cage 150 welded on the gripping member 124. Relative movement between the bolt 146 and the nut 148 pivots the gripping members 122, 124 to the phantom line position shown in FIG. 9 in which the gripping members grippingly engage the lower flange 54 in a non-destructive manner.

Returning to FIG. 5, a plurality of tubular spacers 154, 156 are mounted between the channel members 56, 58 in the middle and outer regions thereof so as to maintain them in a generally parallel rigid relationship. Bolts 158, 160 pass through the spacers 154, 156 and are secured in place by nuts 162, 164. The lower looped end 166 of support cable 72 is looped around the spacer 154 to strengthen the net support system 44. Another bolt 166 successively passes through a selected aperture at the outer end of channel member 56 prior to passing through a hole extending through the inner end 68 of lower arm 66. The bolt 166 continues through an aperture in the outer end of channel member 58 before being secured in position by nut 168. The shaft of bolt 166 serves as a pivot about which the lower arm 66 is free to turn. The bolt 166 could have been placed in any of the holes at the outer end region of the channel members 56, 58, thereby serving as a convenient adjustment point for attachment of the lower arm 66.

Figure 2:
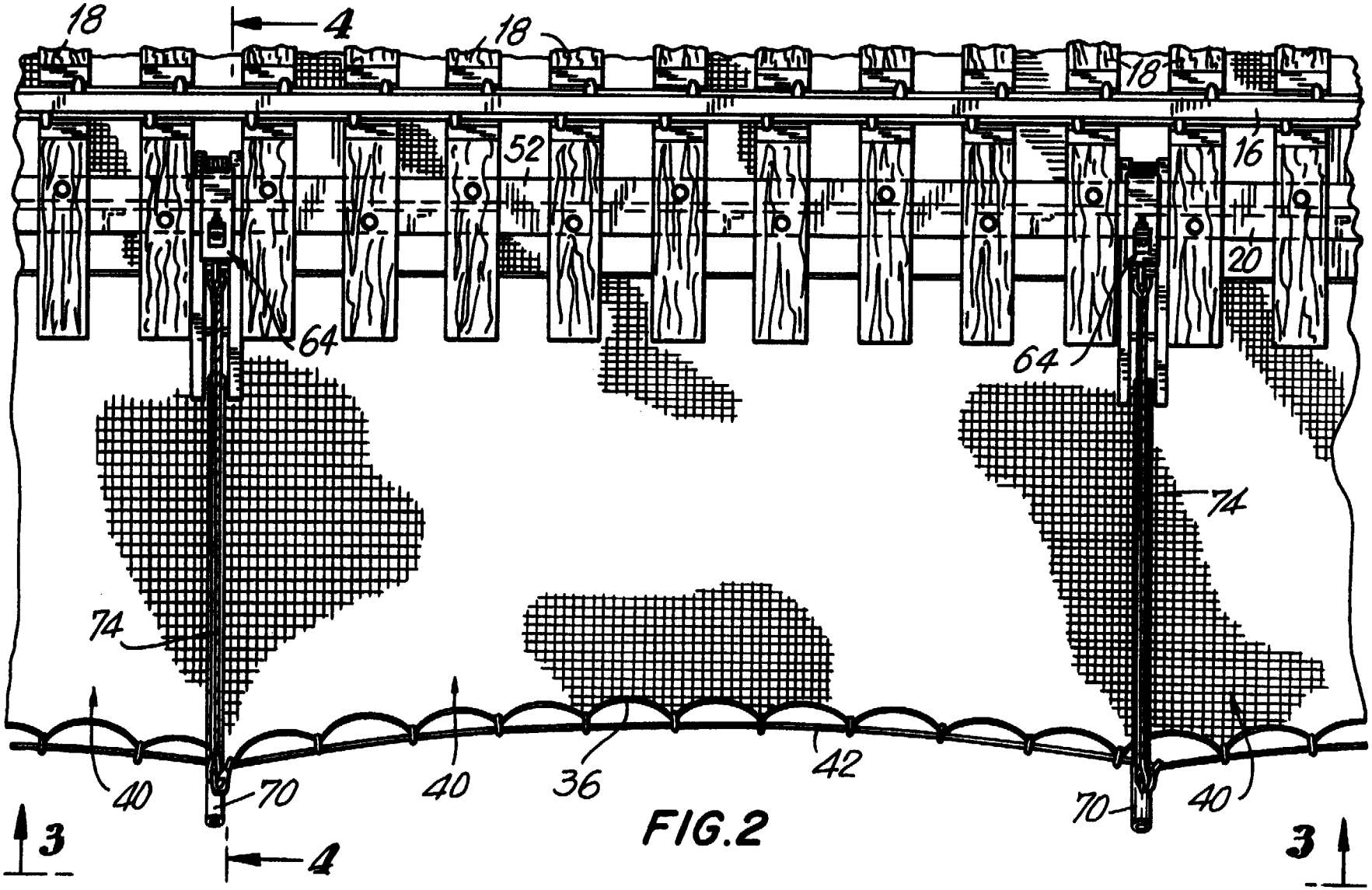
FIG. 2 is a broken-away, enlarged, top plan view of a part of the arrangement of FIG. 1.

Returning to FIG. 1, a plurality of belly nets 170 are operatively slung underneath the bridge. Each belly net 170 has shackles 172 (see FIG. 4) spaced along both outer side edges thereof. The shackles 172 are detachably hooked onto the channel members, preferably around the aforementioned spacers 156. The installation of the safety net arrangement has thus been simplified. Both the clamping assembly 64 and the gripping assembly 60 are respectively mounted on the upper and lower flanges of each beam 20, 22 without having to drill holes in, or otherwise damage the physical integrity of, the beam. As best shown in FIG. 2, each clamping assembly 64 easily fits between adjacent track ties 18 and is readily accessible from above by a worker standing on the ties.

Each gripping assembly 60 is also readily positionable in place on the lower flange by a worker standing on the ties because, as noted above, the gripping assembly 60 is pre-positioned on the inner end regions of the channel members 56, 58 and is swung from the outside (i.e., the net side) to a position underneath the bridge before being elevated onto the lower flange. Both the clamping and gripping assemblies are adjustable so that a single safety net arrangement can be used in many different applications where the widths of the upper and lower flanges of the I-beams are different.

Once installed, the spread nets will catch workers or objects falling off the bridge. To remove each spread net, it is merely necessary to detach the various shackles and to pull on the pull-in rope 74 to pivot the lower arm 66 about its pivot 166 to reach the shackle at the outer end 70 of the lower arm 66.

The channel members, the clamping and gripping assemblies are all preferably constituted of steel. The support cable 72 is preferably a steel cable. The upper and lower arms 62, 66 are preferably formed of aluminum pipe. All of the parts are corrosion-resistant to resist weather.

It will be understood that each of the elements described above, or two or more together, also may find a useful application in other types of constructions differing from the types described above.

While the invention has been illustrated and described as embodied in a safety net arrangement for elevated structures and methods, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A safety arrangement for an elevated structure being at least partially supported by a flanged beam having an upper flange adjacent to, and readily accessible from, the elevated structure, and a lower flange more remote from, and less accessible from, the elevated structure, the arrangement comprising:

(a) a net;

(b) support means for supportably suspending the net in a spread condition in which the net extends generally outwardly away from the elevated structure;

(c) fastener means for non-destructively fastening the support means to the flanged beam while maintaining the net in the spread condition, said fastener means including means for clamping the support means to the upper flange, and means for gripping the support means onto the lower flange, said gripping means being movable to engage said lower flange; and (d) said support means including a plurality of support systems, each having an elongated extension connected to, and extending from, the gripping means at the lower flange; an upper elongated arm connected to, and extending from, the clamping means, at the upper flange; and a lower elongated arm connected to, and extending between, the extension and the upper arm outwardly of the elevated structure.

2. The arrangement according to claim 1; and further comprising additional nets, additional support means, and additional fastener means arranged peripherally of the elevated structure.

3. The arrangement according to claim 2, wherein the elevated structure is a trestle bridge extending along the longitudinal direction; and wherein the additional nets, additional support means and additional fastener means are arranged along the longitudinal direction.

4. The arrangement according to claim 3, wherein the trestle bridge has opposite side regions, and is at least partially supported by an additional flanged beam, each flanged beam being an I-beam located at a respective side region of the trestle bridge; and wherein the additional nets, additional support means and additional fastener means are arranged in two rows along the longitudinal direction, each row at a respective side region of the trestle bridge.

5. The arrangement according to claim 1, wherein the clamping means includes a pair of clamping members at opposite sides of said one flange, and means for drawing the clamping members toward each other to non-destructively clasp onto said one flange.

6. The arrangement according to claim 1, wherein the extension includes a pair of channel members having outer ends spaced outwardly of the elevated structure; and wherein the lower arm is pivotably connected to, and between, the outer ends of the channel members.

7. The arrangement according to claim 1, wherein the gripping means is adjustably connected to the extension.

8. The arrangement according to claim 1, wherein the lower arm is adjustably connected to the extension.

9. The arrangement according to claim 1, wherein each support system has a support cable extending from the clamping means to the extension.

10. The arrangement according to claim 1, wherein each support system has a pull-in rope extending from the clamping means to the lower arm.

11. The arrangement according to claim 1, wherein the net has an inner net edge connected to the clamping means, and an outer net edge connected to the lower arm.

12. The arrangement according to claim 1, wherein the support systems are at opposite sides of the elevated structure; and further comprising a belly net suspended between the support systems underneath the elevated structure.

13. A safety arrangement for an elevated structure at least partially supported by a flanged beam having a web and spaced-apart flanges integral with the web, the arrangement comprising:

(a) a net;

(b) support means for supportably suspending the net in a spread condition in which the net extends generally outwardly away from the elevated structure; and (c) fastener means for non-destructively fastening the support means to the flanged beam while maintaining the net in the spread condition, said fastener means including means for clamping the support means to one of the flanges, and means for gripping the support means onto the other of the flanges, said gripping means including a pair of pivotable gripping members at opposite sides of said other flange, and means for pivoting the gripping members toward each other to non-destructively grip onto said other flange.

14. The arrangement according to claim 13, wherein each gripping member has an apertured part and a bent catch overlying said other flange, and wherein the pivoting means includes a threaded fastener extending through each apertured part.

15. The arrangement according to claim 13, wherein said other flange has a width dimension, and wherein each apertured part has a pivot bearing spaced apart by a distance greater than said width dimension.

16. A method of installing a safety arrangement on an elevated structure at least partially supported by a flanged beam extending along a longitudinal direction and having a web and a pair of vertically spaced-apart flanges integral with the web, comprising the steps of:

(a) non-destructively fastening net support systems to both flanges of the flanged beam, including (i) mounting clamping members on net support systems at locations spaced apart of each other along the longitudinal direction, and moving the clamping members into clamping engagement with one of the flanges, (ii) pivotably mounting gripping members on the net support systems at locations spaced apart of each other along the longitudinal direction, and moving the gripping members while the clamping members are clamped to said one of the flanges from an outer position exteriorly of the elevated structure to an inner position underneath the elevated structure, and (iii) grippingly engaging the other of the flanges of the flanged beam by pivoting the mounted gripping members toward each other; and (b) supportably suspending at least one net from the net support systems in a spread condition in which said one net extends generally outwardly away from the elevated structure.

17. A method of safeguarding workers from injury while working on an elevated structure at least partially supported by a flanged beam extending along a longitudinal direction and having a web and a pair of vertically spaced-apart flanges integral with the web, comprising the steps of:

(a) non-destructively fastening net support systems to both flanges of the flanged beam, including (i) clamping one of the flanges at locations spaced apart of each other along the longitudinal direction, (ii) moving gripping members from an outer position exteriorly of the elevated structure to an inner position underneath the elevated structure while said one of the flanges is clamped, and (iii) grippingly engaging the other of the flanges of the flanged beam by pivoting the gripping members toward each other; and (b) supportably suspending at least one net from the net support systems in a spread condition in which said one net extends generally outwardly away from the elevated structure.

18. A safety arrangement for an elevated structure at least partially supported by a flanged beam having a web and spaced-apart flanges integral with the web, the arrangement comprising:

(a) a net;

(b) support means for supportably suspending the net in a spread condition in which the net extends generally outwardly away from the elevated structure; and (c) fastener means for non-destructively fastening the support means to the flanged beam while maintaining the net in the spread condition, said fastener means including means for clamping the support means to one of the flanges, and means for gripping the support means onto the other of the flanges, said clamping means including a pair of clamping members at opposite sides of said one flange, and means for drawing the clamping members toward each other to non-destructively clasp onto said one flange, one of the clamping members having a hook for hookingly engaging one of said sides of said one flange, and the other of the clamping members engaging the other of said sides of said one flange, said clamping members having juxtaposed apertured legs, and the drawing means being a threaded fastener extending through the apertured legs.

* * * * *